US010941738B1

(12) United States Patent
Puckett et al.

(10) Patent No.: US 10,941,738 B1
(45) Date of Patent: Mar. 9, 2021

(54) METHOD AND SYSTEM FOR SPILL VALVE MOVEMENT DETECTION

(71) Applicant: Caterpillar Inc., Peoria, IL (US)

(72) Inventors: Daniel R. Puckett, Peoria, IL (US); Andrew O. Marrack, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/741,386

(22) Filed: Jan. 13, 2020

(51) Int. Cl.

| | |
|---|---|
| ***F02M 47/02*** | (2006.01) |
| ***F02M 59/36*** | (2006.01) |
| *F02M 59/46* | (2006.01) |
| *F02M 57/02* | (2006.01) |
| *F02D 41/20* | (2006.01) |

(52) U.S. Cl.
CPC ..... *F02M 47/027* (2013.01); *F02M 59/366* (2013.01); *F02D 41/20* (2013.01); *F02D 2041/2017* (2013.01); *F02D 2041/2058* (2013.01); *F02D 2250/31* (2013.01); *F02M 57/025* (2013.01); *F02M 59/466* (2013.01); *F02M 2200/502* (2013.01)

(58) Field of Classification Search
CPC ..... F02M 47/027; F02M 59/366; F02M 2200/502; F02M 57/025; F02M 59/466; F02D 41/20; F02D 2041/2058; F02D 2041/2017; F02D 2250/31
See application file for complete search history.

(56) References Cited

U.S. PATENT DOCUMENTS

| | | | | |
|---|---|---|---|---|
| 4,631,628 | A | 12/1986 | Kissel | |
| 5,986,871 | A | 11/1999 | Forck et al. | |
| 7,013,876 | B1 | 3/2006 | Puckett et al. | |
| 7,469,679 | B2 * | 12/2008 | Puckett et al. | F02M 1/00 123/446 |
| 10,247,122 | B1 * | 4/2019 | Coldren et al. | F02M 59/36 |

FOREIGN PATENT DOCUMENTS

| | | | |
|---|---|---|---|
| DE | 102016218515 | A1 | 3/2018 |
| GB | 2268600 | A | 1/1994 |

* cited by examiner

*Primary Examiner* — Xiao En Mo
(74) *Attorney, Agent, or Firm* — Bookoff McAndrews

(57) ABSTRACT

A method of injecting fuel with a fuel injector includes applying a spill valve current to close a spill valve and applying a control valve current to move a control valve to an injection position. The method also includes discontinuing the application of the spill valve current to open the spill valve and preventing a return of the control valve to a non-injection position while detecting a timing when the spill valve opens.

20 Claims, 3 Drawing Sheets

METHOD AND SYSTEM FOR SPILL VALVE MOVEMENT DETECTION

TECHNICAL FIELD

The present disclosure relates generally to systems for internal combustion engines, and more particularly, to methods and systems for valve movement detection in a fuel injector of an internal combustion engine.

BACKGROUND

Many internal combustion engines include electronic control units that monitor and control aspects of the operation of the engine, including the timing and quantity of fuel injection. Engine control units perform these operations with the use of a series of maps, or other programming, stored in memory of the control unit. In conjunction with these maps or programs, control units receive and calculate various information representative of the operation of the engine. Some engines employ fuel injectors that each have multiple electronically-controlled valves. These valves transition between closed and open states by selectively energizing actuators, such as solenoids, within each injector. These fuel injector solenoids may be connected to a power supply controlled by the control unit. Some control units may be programmed to detect movement of the valves. For example, when solenoids are deactivated, the control unit may detect movement of a valve member based on induced current generated in the solenoid (e.g., free-wheeling current induced by movement of a valve member returning to a resting position). The solenoids may be positioned in close proximity to each other to satisfy size constraints of the injector. However, drive currents of such closely-positioned solenoids in a fuel injector may introduce noise or cross-talk. This cross-talk may impair the ability of the control unit to accurately detect aspects of the fuel injector, such as movement of one or more valves, in particular movement of one or more valves during a relatively short injection event.

A electronic fuel injector driver circuit is disclosed in U.S. Pat. No. 4,631,628 (the '628 patent) to Kissel. The electronic fuel injector driver circuit disclosed in the '628 patent includes a free-wheeling path that allows injector current to decay slowly through a free-wheeling diode circuit at the beginning of an injector control pulse. At the end of the injector control pulse, energy stored in the coil is allowed to dissipate rapidly. While the driver circuit disclosed in the '628 patent may be useful in some circumstances, it may not be useful for detecting a state of a valve with two solenoids positioned in close proximity.

The disclosed method and system may solve one or more of the problems set forth above and/or other problems in the art. The scope of the current disclosure, however, is defined by the attached claims, and not by the ability to solve any specific problem.

SUMMARY

In one aspect, a method of injecting fuel with a fuel injector may include applying a spill valve current to close a spill valve and applying a control valve current to move a control valve to an injection position. The method may also include discontinuing the application of the spill valve current to open the spill valve and preventing a return of the control valve to a non-injection position while detecting a timing when the spill valve opens.

In another aspect, a method of injecting fuel with a fuel injector may include applying a spill valve current to move a spill valve member from an open position to a closed position, energizing a control valve solenoid to move a control valve member from a first position to a second position, and allowing the spill valve member to return to the open position. The method may also include allowing the control valve solenoid to gradually de-energize at a timing that at least partially overlaps a motion of the spill valve member from the closed position to the open position and detecting the return of the spill valve member to the open position.

In yet another aspect, a fuel injection control system may include a power source, a fuel injector including a spill valve and a control valve, and a controller. The controller may be configured to apply a spill valve current to close the spill valve and apply a control valve current to move a control valve member of the control valve to an injection position. The controller may be further configured to discontinue the application of the spill valve current to open the spill valve and delay a return of the control valve member to a non-injection position while detecting a timing when the spill valve open.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," "substantially," "generally," and "approximately" are used to indicate a possible variation of ±10% in the stated value.

Figure 1:
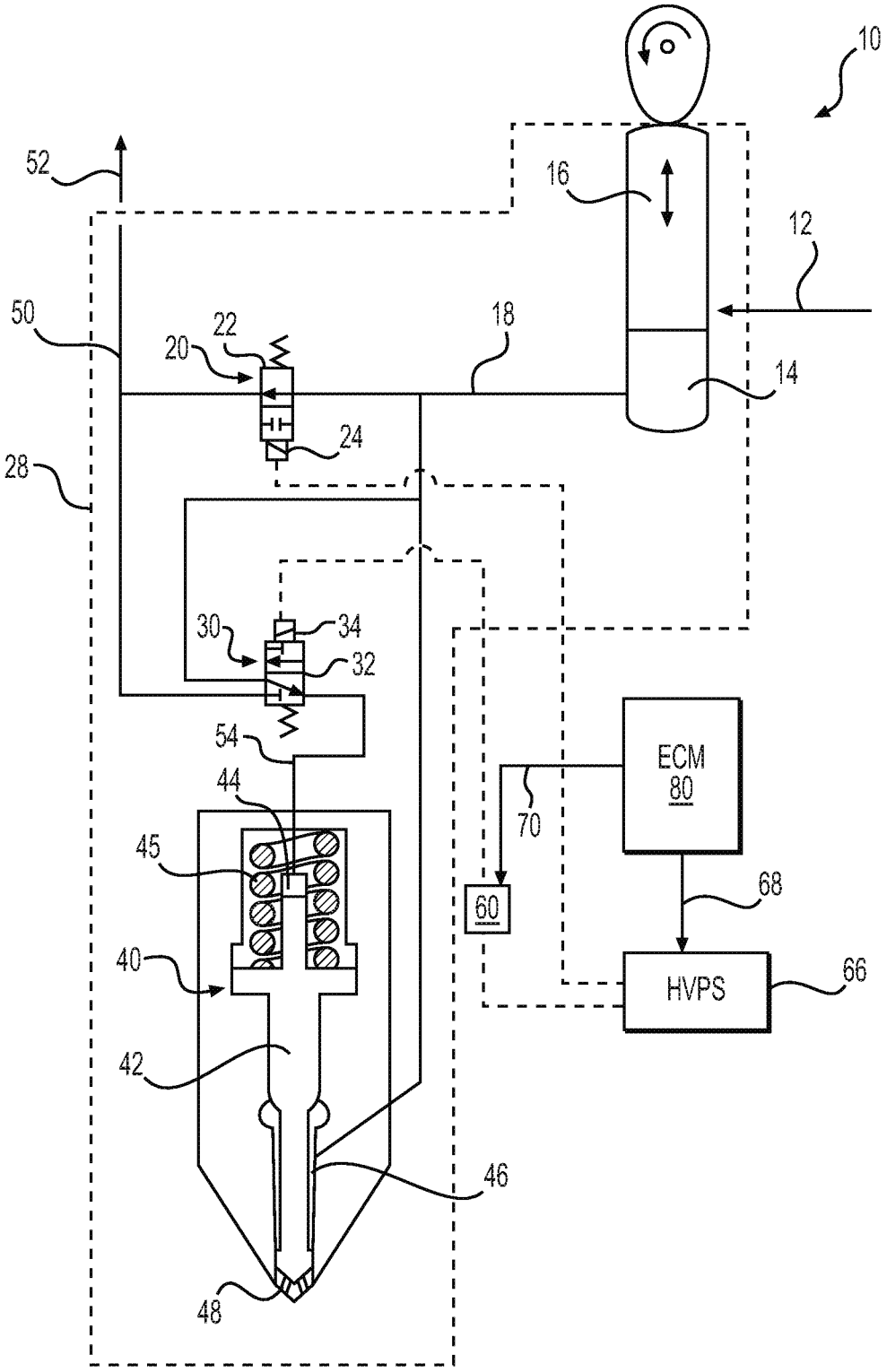
FIG. 1 is a schematic diagram illustrating a fuel injector of an engine system according to an aspect of the present disclosure.

FIG. 1 is a schematic diagram illustrating a fuel injection system 10 according to an aspect of the present disclosure. Fuel injection system 10 may be a component of an internal combustion engine, for example, and may include a fuel injector 28, a power source such as a high-voltage power source (HVPS) 66, and control unit or electronic control module (ECM) 80. Fuel injector 28 may be a mechanically-actuated electronically-controlled unit injector including a fuel reservoir 14 that receives fuel from a fuel source 12 and includes a cam-actuated piston 16 to pressurize fuel within reservoir 14. A high-pressure fuel channel 18 may extend from fuel reservoir 14 to provide pressurized fuel to a spill valve 20, a direct-operated control (DOC) valve 30, and a check valve 40 (via check valve chamber 46) of the fuel injector 28. A low-pressure fuel channel 50 may extend individually from spill valve 20 and DOC valve 30, to a fuel return passage 52 which may recirculate and return fuel to fuel source 12. Spill valve 20 and DOC valve 30 may respectively include a spill valve solenoid 24 and a DOC valve solenoid 34. Spill valve solenoid 24 may be electrically connected to HVPS 66. DOC valve solenoid 34 may be electrically connected to a power application circuit 60 and to HVPS 66. ECM 80 may be configured to output a command signal 68 to HVPS 66 (which may include voltage-boosting circuitry, such as a capacitor circuit and a power source such as a battery), to selectively energize (provide electrical power to) solenoids 24 and 34. ECM may be configured to output a command signal 70 to power application circuit 60 to control a de-energization of DOC valve solenoid 34. In FIG. 1, solid lines (e.g., between valves 20, 30, 40, and fuel reservoir 14 or fuel return passage 52) represent fuel passages, dashed lines represent electrical communication lines or conductors, and arrows extending from ECM 80 represent electrical communication lines for outputting or receiving commands.

Spill valve 20 may be a normally-open, two-way (two-port), two-position valve. When spill valve 20 is open, a spill valve member 22 may be positioned to permit communication between high-pressure fuel channel 18 and low-pressure fuel channel 50. Spill valve member 22 may be biased toward an open position by a spring member, for example. A position of spill valve 20 may be controlled by energizing an actuator, such as spill valve solenoid 24, to generate a magnetic field that controls a motion of spill valve member 22. For example, spill valve 20 may be closed when spill valve solenoid 24 is suitably energized by HVPS 66.

DOC valve 30 may be a normally-closed, three-way (three-port), two-position valve. In a first position of DOC valve 30 illustrated in FIG. 1, referred to as a closed position or non-injection position herein, DOC valve member 32 may be positioned so as to permit communication between a control chamber 44 of check valve 40 and high-pressure fuel channel 18 (via a control chamber passage 54) and block communication between control chamber 44 and low-pressure fuel channel 50. DOC valve member 32 may be biased toward this closed position by a spring member. In a second open or injection position, DOC valve member 32 may block communication between control chamber 44 and high-pressure fuel channel 18, and permit communication between control chamber 44 and low-pressure fuel channel 50. DOC valve member 32 may be drawn to the open position when DOC solenoid 34 is energized by HVPS 66. Power application circuit 60 may be configured to operate in a plurality of de-energization modes to facilitate de-energization of DOC valve solenoid 34. Power application circuit 60 may include a first path including a diode (e.g., Zener diode) or other suitable electrical component or circuit electrically connected to DOC valve solenoid 34 to rapidly de-energize DOC valve solenoid 34. Power application circuit 60 may include a second path (e.g., a free-wheeling path) electrically connected to DOC valve solenoid 34 to allow current to slowly decay (e.g., by redirecting current to DOC valve solenoid 34 in a free-wheeling mode). In a first, rapid de-energization mode, power application circuit 60 may rapidly de-energize DOC valve solenoid 34 to improve a responsiveness of DOC valve 30 by accelerating a timing at which DOC valve member 32 returns to the closed position from the open position. In a second, delayed de-energization or free-wheeling mode, power application circuit 60 may allow DOC valve solenoid 34 to enter a free-wheeling state in which energy (current) within DOC valve solenoid 34 decays relatively slowly, to increase an amount of time DOC valve member 32 is retained in the open position and temporarily prevent the return of the DOC valve member 32 to the closed position.

Check valve 40 may be a one-way needle valve including a needle valve member 42 configured to block or allow communication between a check valve chamber 46 and injection orifices 48. A spring member 45 may bias needle valve member 42 toward the closed position illustrated in FIG. 1. Additionally, needle valve member 42 may be biased towards the closed position when control chamber 44 of check valve 40 is in communication with high-pressure passage 18. Needle valve member 42 may move from this closed position to an open position when DOC valve 30 opens (and while spill valve 20 is closed). For example, when spill valve 20 is closed and DOC valve 30 is open, control chamber 44 may be at a low pressure, thereby allowing pressure within check valve chamber 46 to act against a biasing force of spring member 45 and inject fuel through orifices 48.

Figure 3:
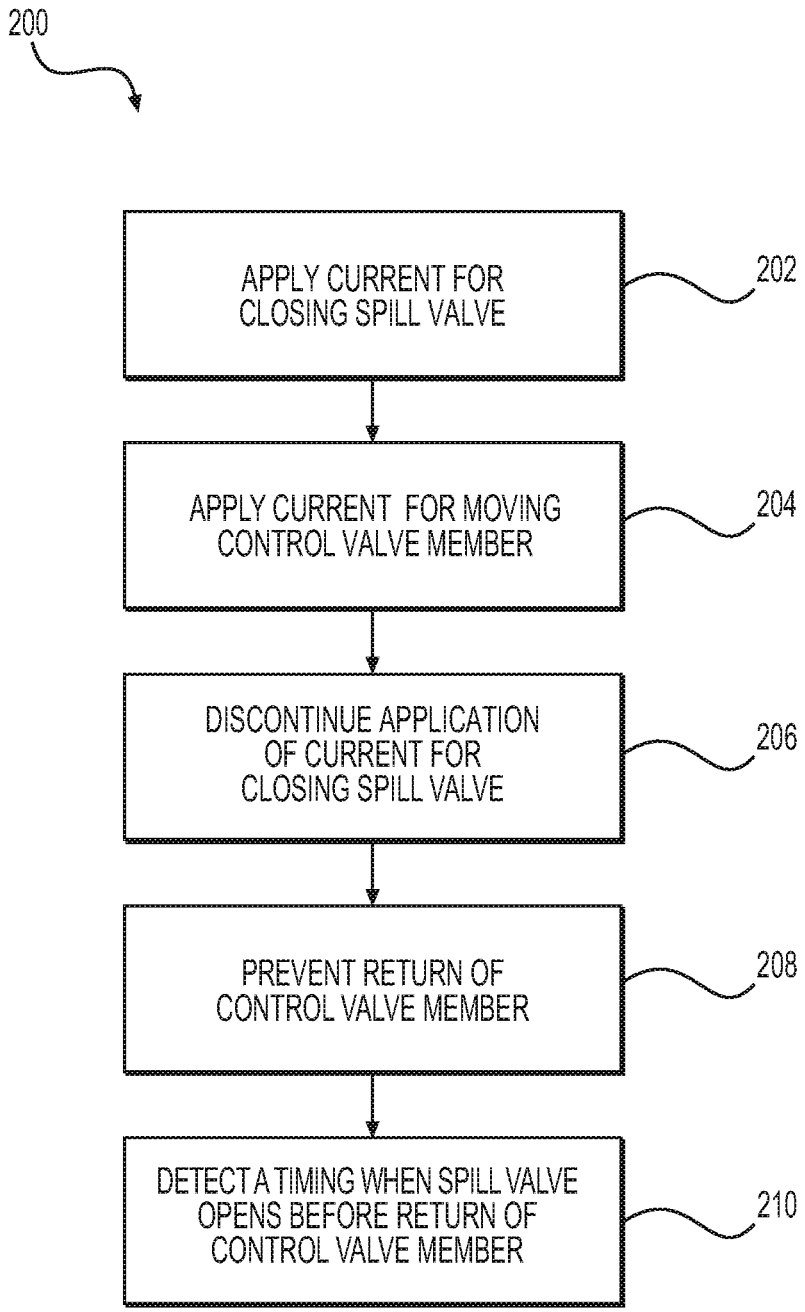
FIG. 3 is a flowchart of a method for detection of motion of a spill valve of the fuel injector according to an aspect of the present disclosure.

ECM 80 may be configured to receive various sensed inputs and generate commands or control signals to control the operation of a plurality of fuel injectors 28. ECM 80 may embody a single microprocessor or multiple microprocessors that receive inputs and issue control signals, including power application commands 70 to control circuitry of power application circuit 60, and HVPS commands 68 to control circuitry of HVPS 66. Commands 68 and 70 may respectively allow ECM 80 to selectively energize solenoids 24, 34 with electrical power from HVPS 66, and de-energize solenoid 34 to control a rate of decay of electrical energy stored by solenoid 34. ECM 80 may include a memory, a secondary storage device, a processor, such as a central processing unit, or any other means for accomplishing a task consistent with the present disclosure. The memory or secondary storage device associated with ECM 80 may store data and software to allow ECM 80 to perform its functions, including the functions described below with respect to method 200 (FIG. 3). In particular, such data and software in memory or secondary storage device(s) may allow ECM 80 to perform any of the adaptive trim and signal (current) analysis described herein. Numerous commercially available microprocessors can be configured to perform the functions of ECM 80. Various other known circuits may be associated with ECM 80, including signal-conditioning circuitry, communication circuitry, and other appropriate circuitry.

INDUSTRIAL APPLICABILITY

Fuel injection system 10 may be used in conjunction with any appropriate machine or vehicle that includes an internal combustion engine. In particular, fuel injection system 10 may be used in any internal combustion engine in which two or more solenoids, such as a spill valve solenoid and a control valve solenoid of a fuel injector, could be subject to cross-talk (e.g., due to being placed in proximity to each other). Moreover, fuel injection system 10 may be used in any internal combustion engine in which it may be desirable to determine a timing at which a valve changes state (e.g., to an open position) based on induced or free-wheeling current generated by a solenoid for a spill valve.

During an operation of an internal combustion engine, fuel injection system 10 may direct fuel, such as diesel fuel, into a combustion chamber of the engine. Each fuel injector 28 may inject fuel during one or more injection events of a cycle of engine 10. For example, fuel injection system 10 may be configured to inject fuel once, twice, or three times during a single cycle of the engine. A largest amount of fuel, as measured in fuel mass, may be injected during a main injection. One or more smaller injection events may occur before or after the main injection. An injection that occurs before the main injection may form a pilot injection, while an injection that occurs after the main injection may form a post injection. A pilot injection that occurs shortly before the main injection may be referred to as a close-coupled pilot injection, while a post injection that occurs shortly after the main injection may be referred to as a close-coupled post injection. Fuel injection system 10 may also be configured to detect and evaluate the motion of spill valve member 22 during a minimum-duration injection (an injection that injects the smallest possible quantity of fuel and which may occur during depressurization of fuel within fuel injector 28). Fuel injection system 10 may, while the internal combustion engine is operating, continuously monitor the operation of fuel injector 28 and adjust the timing of the pilot, main, and/or post injections based on feedback or sensed information and operator commands. Information sensed during a minimum-duration injection event, for example, may be used during one or more subsequent injections to reduce a quantity of undesirable compounds emitted by the internal combustion engine.

Figure 2:
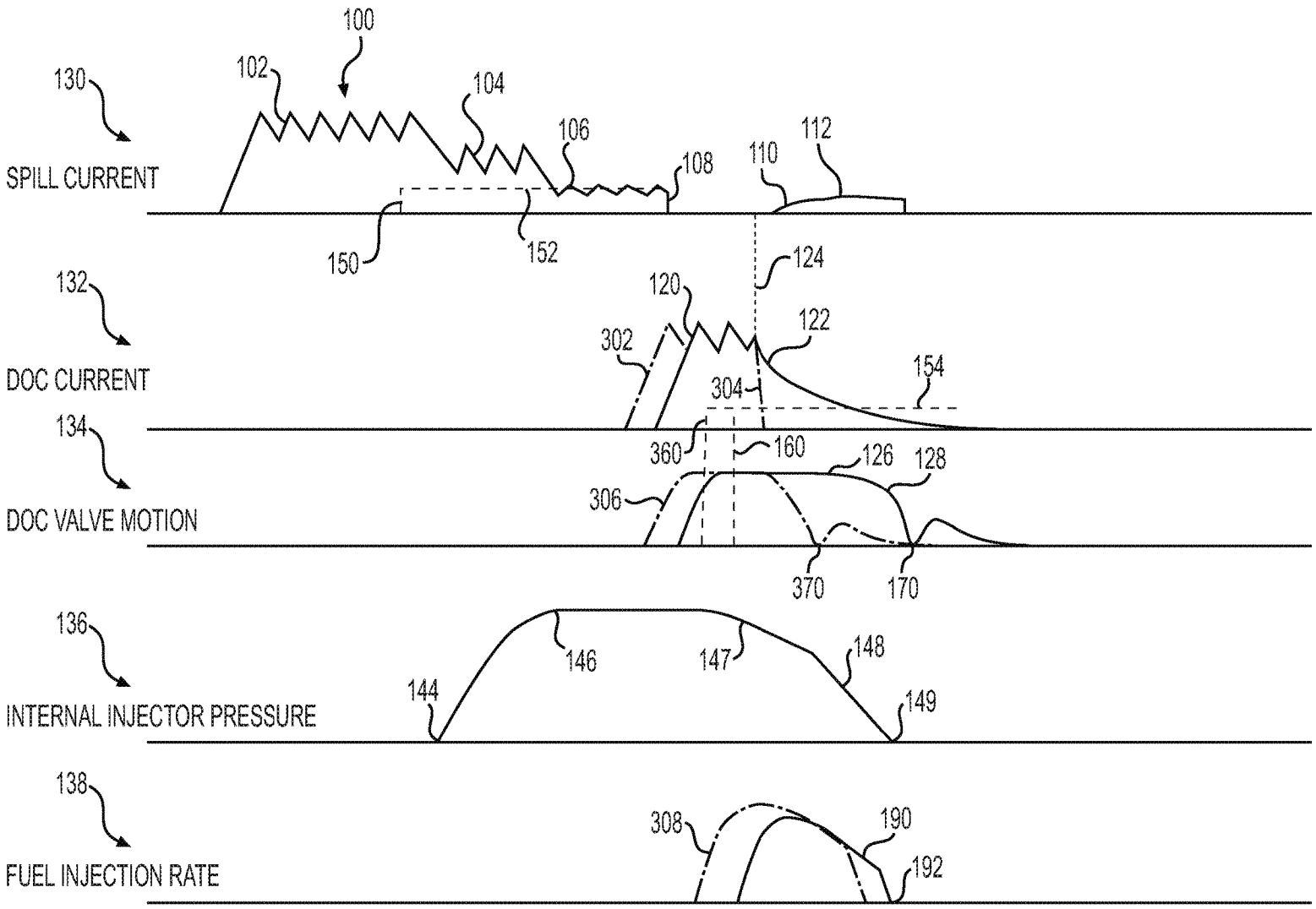
FIG. 2 is a chart illustrating a correlation of operational aspects of the fuel injector of FIG. 1, including waveforms of a current through a circuit of a spill valve, a current through a circuit of a DOC valve, a motion of the DOC valve, an internal pressure within the fuel injector, and a rate of fuel injection.

FIG. 2 is a chart illustrating plots 130, 132, 134, 136, and 138, which respectfully represent exemplary spill and DOC current, DOC valve motion, internal injector pressure, and rate of fuel injection during an exemplary minimum-duration injection event. A first plot of spill current waveform 130 of FIG. 2 represents an exemplary amount of current that passes through spill valve solenoid 24 to facilitate this injection. As discussed above, the application of current to solenoid 24 may cause the spill valve member 22 to move to (and be held in) a closed position, preventing high-pressure fuel from entering low-pressure fuel channel 50. This waveform also illustrates an exemplary amount of current (current 110) that is generated in solenoid 24 due to current (e.g., free-wheeling current) induced by motion of spill valve member 22 during a return from a closed position to an open position, as described below. The chart of FIG. 2 includes a second plot of DOC current waveform 132 below spill current waveform 130, that corresponds to an exemplary amount of current that is applied to DOC valve solenoid 34 to move DOC valve member 32 to an open position associated with an injection of fuel and retain DOC valve member 32 in this position for a desired period of time. FIG. 2 includes a corresponding third plot 134 of motion of DOC valve member 32. A fourth plot or waveform 136 of an internal injector pressure, such as a pressure of fuel within fuel channel 18 and check valve chamber 46. A lower portion of FIG. 2 includes a quantity of injected fuel waveform 138. Each of the five portions (x-axes) of FIG. 2 correspond to the same period of time.

With reference to the spill current waveform 130 illustrated in FIG. 2, an injection event, such as a minimum-duration injection, may begin with the application of chopped spill valve current 100. Chopped current may be a current that is regularly interrupted or cycled between connected and disconnected states so as to provide an approximately constant average amount of current. This chopped spill valve current 100 may be applied, for example, via HVPS 66 in accordance with commands 68 from ECM 80. In order to overcome the resistance of the spring member of spill valve 20, an initial level 102 of chopped current 100 may be applied to spill valve solenoid 24. In one aspect, once this initial resistance has been overcome, spill valve member 22 may reach a closed position (e.g., at timing 150). An amplitude of chopped current 100 may be reduced from a pull-in or initial level 102 to a keep-in or intermediate level 104 following timing 150. As intermediate level 104 is greater than a minimum threshold spill current 152 necessary for maintaining spill valve member in the closed position, spill valve 20 may remain closed, preventing high-pressure fuel from flowing to low-pressure fuel channel 50. Intermediate level 104 may have a magnitude sufficient to draw spill valve member 22 to a stop or seat of spill valve 20, and to overcome the tendency of spill valve member 22 to bounce at this stop. At a later time, a third, hold-in or minimum current level 106 may be applied following intermediate level 104. Once current is no longer applied to solenoid 24 (e.g., at the termination of chopped spill valve current 100 at timing 108) valve member 22 may begin to return to the open position. The travel of valve member 22 from the closed position to the open position may induce a detectable induced current 110 (e.g., via a free-wheeling circuit monitored by ECM 80). ECM 80 may be configured to detect a return of the spill valve 20 to the open state based on a measured peak 112 or maximum amount (maximum amplitude) of induced free-wheeling current 110.

With reference to the phantom-line portions of DOC current and DOC valve motion waveforms 132 and 134, an exemplary injection strategy may include initiating and terminating injection with DOC valve 30. As shown in DOC current waveform 132, ECM 80 may apply chopped current 302 to energize DOC valve solenoid 34. This chopped current 302 may cause DOC valve member 34 to move (as represented by valve motion 306 in waveform 134) and reach an open (injection) position at timing 360. Chopped current 302 may be applied until timing 124, and may exceed a minimum threshold DOC current 154 necessary to maintain the DOC valve member 32 at this open position. The application of chopped current 302 thus may secure or latch the DOC valve member 32 in the open position during the application of this current 302. At the termination of the application of chopped current 302 at timing 124, electrical energy in solenoid 34 may be driven-down (as represented by driven-down current 304), by outputting a power application command 70 to cause power application circuit 60 to operate in the rapid de-energization mode. DOC valve member 32 may thus travel from the open position to the closed position, reaching the closed position at DOC valve closure timing 370. The return of the DOC valve member 32 to the closed position at timing 370 may begin termination of the injection by raising the pressure within control chamber 44 (see injection 308 of injection rate waveform 138). This strategy may provide an injection 308 that is terminated by DOC valve 30.

In order to evaluate a minimum injection that is terminated by spill valve 20 instead of DOC valve 30, current may be applied to DOC valve solenoid 34 in a manner that delays or temporarily prevents movement of DOC valve member 32 from the open position to the closed position without the use of chopped current. This delayed return of DOC valve member 32 is illustrated by valve motion 126 of valve motion waveform 134. In order to open the DOC valve 30 for the minimum amount of time, it may be desirable to delay a timing of the application of chopped current, e.g., as shown by chopped DOC current 120 in waveform 132. As a result, DOC valve member 34 may reach the open position at delayed timing 160 as compared to timing 360. This chopped DOC current 120 may be applied to DOC valve solenoid 34 until timing 124. At timing 124 (which occurs before induced current 110 is detected), in order to delay the closing of DOC valve 30, ECM 80 may issue a command 70 to power application circuit 60 that causes power application circuit 60 to enter the delayed de-energization or free-wheeling mode. This may cause DOC valve 30 to enter a free-wheeling state, in which a gradual current decay 122 occurs in DOC valve solenoid 34, rather than a rapid de-energization or pull-down (e.g., driven-down current 304). This gradually-decaying electrical energy or current 122 may initially exceed minimum threshold DOC current 154, and may thereby provide sufficient force to hold or latch the DOC valve member 32 in the open position for a period of time that at least partially overlaps the return of spill valve member 22 to the open position. Once the magnitude of the decaying current 122 falls below minimum threshold DOC current 154, the force generated by DOC valve solenoid 34 may be less than the force of the spring that biases DOC valve member 32 to the closed position. At this time, as shown by valve return motion 128, DOC valve member 32 may begin to transition from the open position to the closed position. DOC valve member 32 may reach the closed position at delayed DOC valve closure timing 170, after the detection of peak 112 of free-wheeling current 110. Thus, return of the control valve member 32 to the closed position may be prevented until spill valve 20 opens at an end of an injection.

As shown in the fourth plot 136 of injector pressure, the pressure of fuel within injector 28 may begin increasing at a build-up timing 144. This may be caused by a cam-actuated motion of piston 16 (FIG. 1), for example, applying pressure to fluid within injector 28 while spill valve 20 is closed. This internal pressure may reach a maximum pressure level 146. Pressure may begin to be relieved at a first or initial pressure decline 147 due to a return motion of piston 16, for example, relieving pressure imposed on fuel within injector 28. This initial decline 147 may transition to an accelerated pressure decline 148, as spill valve 20 opens. The injection pressure 136 may reach (approximately zero) at pressure-release timing 149.

As can be seen in plots 134 and 136, the delayed valve motion 126 and extended period of time during which DOC valve 30 is open may occur at least partially during declines 147 and 148 in the internal injector pressure. Additionally, the motion of the spill valve member 22 (causing the generation of induced current 110) may begin during decline 147, which may facilitate injection of a minimum quantity of fuel, as shown in plot 138. Thus, a delayed fuel injection 190 may occur after fuel injection 308. Additionally, delayed fuel injection 190 may terminate at an injection termination timing 192 that occurs prior to DOC valve closure timing 170, as termination timing 192 may be caused by the opening of spill valve 20.

ECM 80 may be configured to adjust the timings and/or duration of one or more subsequent fuel injections based on the detected timing of peak current 112. In some aspects, ECM 80 may utilize this detected timing to perform a minimum-duration injection in which spill valve 20 controls the end of the injection. Such minimum-duration injection may also be performed at a timing that overlaps the minimum internal injector pressure, which may facilitate controllable injection of a minimum amount of fuel. The detection of peak current 112 may also be employed to control an injection timing, such as a duration and/or dwell for one or more of a pilot, main, or post injection.

FIG. 3 illustrates an exemplary method 200 that may be performed by fuel injection system 10, and in particular, by ECM 80. In a first step 202, current may be applied to close spill valve 20. This current may be, for example, applied as chopped spill valve current 100 (levels 102, 104, and/or 106). This current may be sufficient to move spill valve member 22 from an open position to a closed position, transitioning spill valve 20 to a closed state. In a step 204, ECM 80 may cause current to be applied to move DOC valve member 32 to an injection position associated with an open state of DOC valve 30. This current may be applied, for example, as chopped DOC current 120 until timing 124. The application of chopped DOC current 120 may cause DOC valve member 32 to reach the open (injecting) position at timing 160. In step 206, ECM 80 may discontinue the application of current to hold spill valve 20 closed (e.g., chopped spill valve current 100). Step 206 may be performed before step 204, after step 204, or at least partially concurrently with step 204.

Step 208 may include delaying or preventing a return of the DOC valve member 32 so as to delay closing of the DOC valve 30 until after the return of spill valve member 22 to the open position. This may include, for example, transitioning DOC solenoid 34 to a free-wheeling state with power application circuit 60, which results in gradually-decaying electrical energy or current 122 that extends the amount of time that DOC valve 30 remains open. In one aspect, this may be performed without applying chopped current to DOC solenoid 34. Step 210 may include detecting a timing at which spill valve 20 opens, e.g., by detecting a peak 112 of induced current 110. Steps 208 and 210 may be performed at least partially concurrently. Thus, the peak 112 may be detected while DOC valve 30 is open.

While shown separately in FIG. 1, spill valve 20, DOC valve 30, and check valve 40 may be provided in respective bodies within a single housing of fuel injector 28. In the exemplary configuration discussed above, power application circuit 60 is described as separate from HVPS 66. However, if desired, power application circuit 60 may be included in the circuitry for HVPS 66. Additionally, while an exemplary method for delaying a return of DOC control member 32 to a non-injection position may be accomplished by allowing DOC valve 30 and DOC valve solenoid 34 to enter a free-wheeling state, the delay may also be accomplished with the use of a relatively low-voltage battery that provides a current sufficient to latch DOC valve member 32 in the injection position at least partially during the return of spill valve 20 to the open position. Such a current may have a magnitude less than chopped current 120 and a magnitude greater than or equal to threshold 154.

Accurate information regarding the travel of the spill valve may be useful for robust control, particularly of depressurization timing due to the opening of the spill valve. This information may be desirable for determining a minimum controllable injection or shot. Information gathered with respect to the opening of the spill valve may be employed in a pilot injection, for example, or with any other suitable injection strategy. A controllable minimum injection may be useful for improving emissions performance by reducing a quantity of undesirable compounds in exhaust emissions. By holding a control valve, such as a DOC valve, in an injection state during depressurization, it may be possible to detect a return of the spill valve member 22 to an open position without interference that would be introduced if chopped current were employed to hold the control valve in the injection state. Thus, the method and system may provide more information to a control unit that is then used to adjust timing of one or more subsequent injections. For example, such a control unit may adjust the timing of the beginning of an injection, end of injection, a duration of the injection, and/or a timing between different injections.

It will be apparent to those skilled in the art that various modifications and variations can be made to the disclosed method and system without departing from the scope of the disclosure. Other embodiments of the method and system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. A method of injecting fuel with a fuel injector, the method comprising:

applying a spill valve current to close a spill valve;

applying a control valve current to move a control valve to an injection position;

discontinuing the application of the spill valve current to open the spill valve; and preventing a return of the control valve to a non-injection position while detecting a timing when the spill valve opens.

2. The fuel injection method of claim 1, wherein discontinuing the application of spill valve current causes the spill valve to open before the control valve returns to the non-injection position.

3. The fuel injection method of claim 1, wherein preventing the return of the control valve to the non-injection position includes allowing a control valve solenoid to gradually discharge electrical energy.

4. The fuel injection method of claim 3, wherein the electrical energy in the control valve solenoid gradually discharges at a timing that overlaps the timing when the spill valve transitions from closed to open.

5. The fuel injection method of claim 1, further including injecting fuel while the spill valve transitions from closed to open.

6. The fuel injection method of claim 5, wherein the fuel is injected at least partially during a depressurization of fuel within the fuel injector.

7. The fuel injection method of claim 1, wherein the control valve current is a chopped current applied after the spill valve closes and before the spill valve opens.

8. The fuel injection method of claim 1, wherein the timing when the spill valve opens is detected by detecting current induced by a motion of a spill valve member from a closed position to an open position.

9. The fuel injection method of claim 1, wherein the return of the spill valve to the open position causes an injection of fuel by the fuel injector to terminate.

10. A method of injecting fuel with a fuel injector, comprising:

applying a spill valve current to move a spill valve member from an open position to a closed position;

energizing a control valve solenoid to move a control valve member from a first position to a second position;

allowing the spill valve member to return to the open position;

allowing the control valve solenoid to gradually de-energize at a timing that at least partially overlaps a motion of the spill valve member from the closed position to the open position; and detecting the return of the spill valve member to the open position.

11. The fuel injection method of claim 10, wherein the return of the spill valve member to the open position occurs before the control valve member returns to the first position due to de-energizing of the control valve solenoid.

12. The fuel injection method of claim 10, wherein gradually de-energizing the control valve solenoid at least partially overlaps the return of the spill valve member to the open position.

13. The fuel injection method of claim 10, wherein detecting the return of the spill valve member to the open position is performed by detecting a maximum amount of current generated by a movement of the spill valve member when returning to the open position.

14. A fuel injection control system, comprising:

a power source;

a fuel injector including a spill valve and a control valve; and a controller configured to:

apply a spill valve current to close the spill valve;

apply a control valve current to move a control valve member of the control valve to an injection position;

discontinue the application of the spill valve current to open the spill valve; and delay a return of the control valve member to a non-injection position while detecting a timing when the spill valve opens.

15. The control system of claim 14, wherein the controller is configured to detect the timing when the spill valve opens based on a current induced by a spill valve member.

16. The control system of claim 14, wherein the controller is configured to delay the return of the control valve member to the non-injection position without applying chopped current to a control valve solenoid.

17. The control system of claim 14, wherein the controller is configured to delay the return of the control valve member to the non-injection position by allowing a control valve solenoid to gradually de-energize.

18. The control system of claim 17, wherein the gradual de-energizing of the control valve solenoid occurs while the spill valve transitions from closed to open.

19. The control system of claim 14, wherein the controller is configured to cause the fuel injector to inject fuel while fuel within the fuel injector depressurizes.

20. The control system of claim 19, wherein the controller is configured to detect the timing when the spill valve opens during the injection of fuel.

* * * * *